US006894438B2

(12) United States Patent
Han et al.

(10) Patent No.: US 6,894,438 B2
(45) Date of Patent: May 17, 2005

(54) LIGHTING SYSTEM AND METHOD INCORPORATING PULSED MODE DRIVE FOR ENHANCED AFTERGLOW

(75) Inventors: Sung Su Han, Niskayuna, NY (US); Joseph Darryl Michael, Schoharie, NY (US); Ralph William Moulder, Chardon, OH (US)

(73) Assignee: General Electric Company, Nishayuna, NY (US)

( * ) Notice: Subject to any disclaimer, the term of this patent is extended or adjusted under 35 U.S.C. 154(b) by 9 days.

(21) Appl. No.: 10/319,443

(22) Filed: Dec. 13, 2002

(65) Prior Publication Data

US 2004/0113563 A1 Jun. 17, 2004

(51) Int. Cl.[7] ..... H05B 39/04; H01J 11/04

(52) U.S. Cl. ..... 315/219; 315/291; 315/247; 315/339; 315/334; 315/336; 315/169.3; 315/246; 313/491; 313/518; 313/631; 313/346 R

(58) Field of Search ..... 315/219, 291, 315/247, 339, 334, 336, 246, 326, 169.4, 237, 302, 340; 313/491, 518, 631, 346 R, 360

(56) References Cited

U.S. PATENT DOCUMENTS

| | | | | | |
|---|---|---|---|---|---|
| 4,004,175 | A | * | 1/1977 | Brody | 313/360.1 |
| 4,391,901 | A | * | 7/1983 | Land et al. | 430/495.1 |
| 5,363,019 | A | * | 11/1994 | Itatani et al. | 315/169.1 |
| 5,592,052 | A | * | 1/1997 | Maya et al. | 315/291 |
| 5,610,477 | A | * | 3/1997 | Ivanov et al. | 313/573 |
| 6,057,635 | A | * | 5/2000 | Nishimura et al. | 313/25 |
| 6,157,145 | A | * | 12/2000 | Vollkommer et al. | 315/339 |
| 6,274,986 | B1 | * | 8/2001 | Devonshire et al. | 315/291 |
| 6,635,991 | B1 | * | 10/2003 | Bakker et al. | 313/568 |

* cited by examiner

*Primary Examiner*—Hoanganh Le
*Assistant Examiner*—Chuc Tran
(74) *Attorney, Agent, or Firm*—Fletcher Yoder

(57) ABSTRACT

A lighting system that includes a lamp and a control circuit configured to apply signals to the lamp in pulsed mode operation. The lamp may employ ferroelectric ceramic cathodes to enhance life of the lamp when used with the pulsed mode drive circuitry. The drive circuitry applies signals within a desired frequency range to lower input power while providing enhance output within a desired wavelength band, such as 365 nm to make use of an afterglow regime from an emissive medium within the lamp.

47 Claims, 3 Drawing Sheets

LIGHTING SYSTEM AND METHOD INCORPORATING PULSED MODE DRIVE FOR ENHANCED AFTERGLOW

BACKGROUND OF THE INVENTION

The present invention relates similarly to the field of lighting systems, such as fluorescent light systems. More particularly, the invention relates to a lighting system employing pulsed mode driving techniques to utilize emissions in an afterglow regime.

A wide variety of lighting systems are known and are currently in use. The systems include a variety of incandescent and gaseous emissive systems which produce visible light when a drive signal is applied to input terminals. In systems employing gaseous media, a gas or gas mixture is typically provided in a tube, or translucent or transparent shell. A discharge is produce through the gas as signals are applied to anode and cathode structures. The discharge produces emissions from the gas which may be transmitted directly through the shell or which may be transformed to other wavelengths by various materials disposed on or about the shell. Typical materials on fluorescent lamps include various phosphor mixtures which convert wavelengths of emissions from the gas to desired spectra.

The overall efficiency of a lighting system employing a gaseous medium for emissions may be considered a ratio of input power to output light emission. In general, however, specific gases and gas mixtures will emit light in specific bands or spectral ranges when excited by the input signals and the resulting discharge. Depending upon the energy levels and bands emitted by the gaseous medium, the phosphors convert the energy to other wavelengths, typically within a visible light spectrum comprising wavelengths of from approximately 420 nm to approximately 760 nm.

For example, mercury gas lamps typically produce emissions within specific bands of the spectrum, including a band of approximately 254 nm wavelength, and another at approximately 365 nm. Phosphors used to convert these emissions to a visible spectrum, however, do not typically have the same conversion efficiencies at the different wavelength bands. Specifically, currently used phosphors on certain low pressure discharge lamps do not as efficiently convert more intense 254 nm emissions from mercury as they do 365 nm emissions. While adjustments can be made to the phosphors, and to the gas, there is a need in the art for improved techniques for controlling the emissions such that greater efficiencies can be maintained by relying upon the longer 350 nm wavelengths for higher ratios of the overall energy output.

BRIEF DESCRIPTION OF THE INVENTION

The invention provides a lighting system designed to respond to such needs. The techniques employed in the lighting system may be used with a wide variety of lamp types, including conventional linear fluorescent lamps of various size and dimension. Moreover, the techniques may be used with various lamp designs, including low pressure discharge lamps. Similarly, the techniques may be used with various emissive gases, including mercury as well as other gases, and various inert or buffer gases used in conjunction with such emissive gases.

In accordance with one aspect of the technique, a fluorescent lighting system ir provided. The system includes a hollow vessel, a fluorescent layer disposed on an interior surface of the vessel, and a gaseous medium disposed within the vessel. Electrodes are provided in contact with the gaseous medium, at least one of the electrodes comprising a ceramic structure. A drive circuit is coupled to the electrodes and adapted to apply pulsed drive signals to at least one of the electrodes from a non-zero voltage to a desired maximum voltage to produce light emission from the gaseous medium within a desired wavelength.

In accordance with another aspect of the technique, a fluorescent lighting system includes a hollow vessel, a fluorescent layer disposed on an interior surface of the vessel, and a gaseous medium disposed within the vessel. An anode is in contact with the gaseous medium, as well as an emissive ferroelectric ceramic cathode. A drive circuit coupled to the anode and the cathode, and is adapted to apply pulsed drive signals to the cathode from a non-zero voltage to a desired maximum voltage to produce light emission from the gaseous medium within a desired wavelength. The drive signals include pulses producing an afterglow regime including an elevated level of the desired wavelength emission from the gaseous medium. The pulses are of a duration and frequency based upon a duration of the afterglow regime.

A lighting system is also provide that includes a fluorescent lamp having a gaseous emissive medium and ferroelectric ceramic cathode in contact with the medium, and a drive circuit configured to apply drive signals to the cathode in pulsed mode to increase emissions within a 365 m wavelength band.

A method is also provided for operating a fluorescent lighting system. The method includes applying pulsed drive signals to a lamp having a ferroelectric ceramic cathode in contact with a gaseous emissive medium. The drive signals comprise voltage pulses rising from a non-zero voltage to a desired maximum voltage to produce light emission from the gaseous medium within a desired wavelength. The drive signals include pulses producing an afterglow regime including an elevated level of the desired wavelength emission from the gaseous medium. Moreover, the pulses are of a duration and frequency based upon a duration of the afterglow regime.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
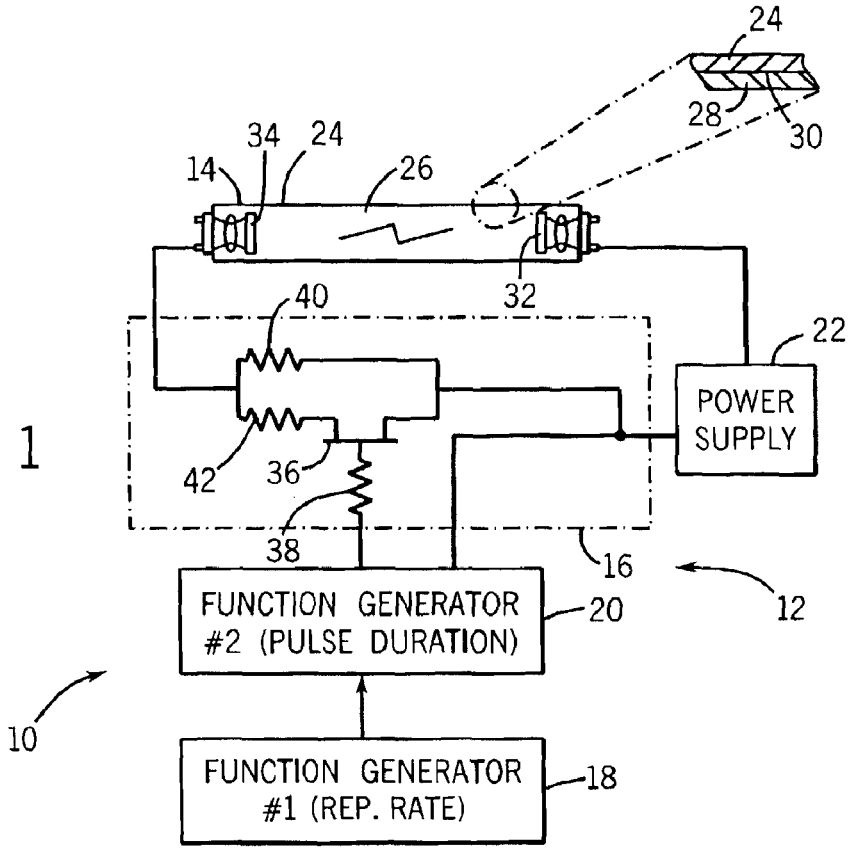
FIG. 1 is a diagrammatical representation of a lighting system incorporating aspects of the present technique.

Returning now to the drawings, and referring first to FIG. 1, a lighting system 10 is illustrated diagrammatically as including a control circuit 12 and a lamp 14. The control circuit implements a pulsed mode drive technique for applying electric power to the lamp 14 as described in greater detail below. In general, any suitable circuits may be employed for the control circuit 12, and the control circuit may be incorporated in a conventional package associated with a lamp support, or in separate packaging which can be added onto a conventional system, such as in an upgrade. The lamp 14 may include a wide range of lamps, and is generally referred to herein as a fluorescent lamp. The lamp may be designed to conform to existing size and envelope dimensions, such as standard T3 (⅜" diameter), T8 (1" diameter) or any other suitable or desired size or rating. Moreover, while the lamp illustrated in FIG. 1 is a linear fluorescent lamp, other structures may also benefit from certain aspects of the present techniques.

The control circuit 12 includes a switching circuit 16 coupled to first and second function generator circuits 18 and 20. In a present implementation, the function generators 18 and 20 generate output signals which drive the switching circuit to provide a desired repetition rate for pulses applied to lamp 14, and to maintain the pulses for desired durations. Many such circuits may be envisioned by those skilled in the art to implement the techniques described herein, and the circuits may be based upon analog or digital technology for generating the repetition rate and pulse duration signals. A power supply circuit 22 is coupled to the switching circuit and to lamp 14 to provide power for driving the lamp. The power supply is also coupled to the function generators to provide necessary power for their operation.

The lamp 14, which may in practice include more than one lamp, is coupled to the control circuit 12, will generally include a tube or shell 24, such as a glass tube. A gaseous medium 26 is provided within the shell 24 and is designed to produce emissions within desired spectral bands upon application of drive signals to the lamp. As noted above, various gases may be used in conjunction with the present techniques, including atomic and molecular mercury, and buffer gases such as argon, helium or other inert gases. Other emissive gases may include, for example, neon. However, the present technique is not limited to use with any particular emissive medium. Similarly, the technique may be used with lamps having various internal gas pressures. In a presently contemplated application, the emissive medium is a mercury-rare gas low pressure discharge medium. A buffer gas pressure may, however, range widely, such as between 1 and 5 Torr.

The shell 24 may be coated with a conversion substance, such as a phosphor mixture 28 designed to convert emissions from the gaseous medium to emissions within a desired wavelength range. Many such phosphor mixtures are known and currently available, and in a present embodiment, the phosphor mixture converts emissions within a range of wavelength bands, including 254 nm emissions and 365 nm emissions to a visible spectrum. Phosphors may also be provided to convert the emissions to specific color or temperature ranges, and so forth. The phosphor 28 is deposed on an inner surface 30 of the shell 24.

Lamp 14 further includes an anode 32 and cathode 34. It has been determined in the present technique that the particular pulsed mode operation used to produce enhanced 365 nm emissions employing an afterglow regime, as described below, can be particularly destructive of many conventional cathode structures. Accordingly, in accordance with the present technique, a ferroelectric ceramic cathode structure is preferably employed so as to withstand the pulsed mode operation applied by the control circuit 12. Any suitable anode may be employed, such as an aluminum anode, for applying the drive signals to the lamp.

The switching circuit 16 may be configured in a wide range of manners, and again may include analog or digital circuit components. In general, the switching circuit acts upon the signals received from function generators 18 and 20 and switches elevated power pulses on and off in a desired manner for application to the anode and cathode of the lamp. In the illustrated embodiment, the switching circuit 16 includes a solid state switch 36, a resistor 38, and a pair of parallel resistors 40 and 42. The switch 36 may be of any suitable type, such as a conventional transistor driven by input signals from function generators 18 and 20 to complete current carrying paths between the power supply 22 and the cathode 34 of the lamp. The resistors in the circuit illustrated in FIG. 1 may be selected according to the drive voltage, anticipated currents, pulse characteristics, and so forth. In a presently contemplated embodiment resistor 38 has a value of 10 Ω, resistor 40 has a value of 25 kΩ, and resistor 42 has a value of 21 Ω. Power supply 22 may similarly vary in voltage and current rating and, in a presently contemplated embodiment, a 0 to 600 Vdc power supply is employed.

The circuitry illustrated in FIG. 1 preferably drives the lamp in a pulsed mode of operation wherein an afterglow regime of the gaseous medium is utilized to reduce power input to the lamp and to produce additional emission within a desired wavelength band. In particular, for a mercury-rare gas fluorescent lamp, it has been determined in the present technique that an afterglow will be present within the 365 nm wavelength band at a particular time period following a drive pulse. Thus, by appropriately timing pulses, and providing pulses of desired durations, the afterglow produced by the gaseous medium is converted to the desired wavelength range without significant additional input to the lamp, thereby improving output at the desired frequency band while simultaneously reducing overall input energy.

Figure 2:
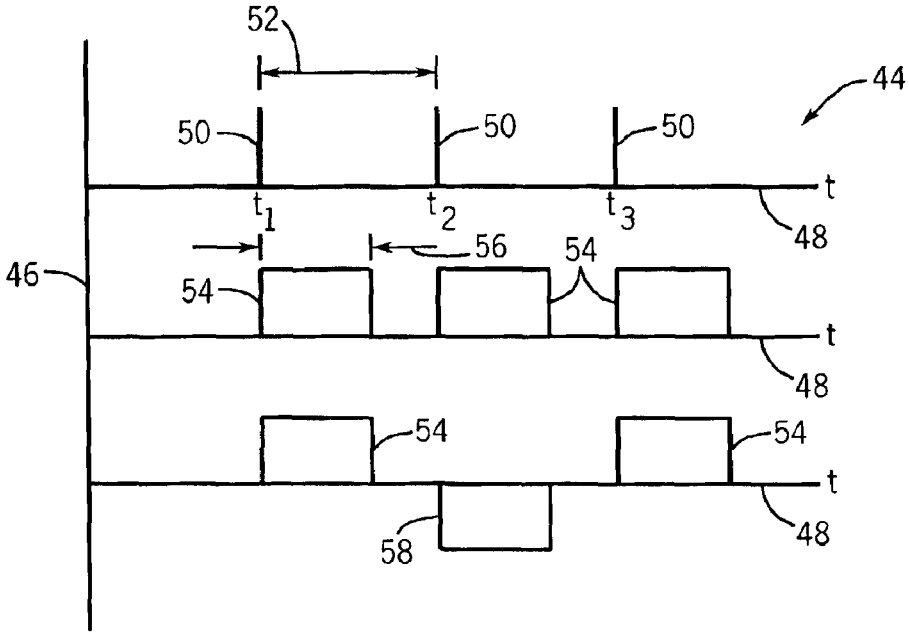
FIG. 2 is graphical representation of pulses employed in a present embodiment of a pulsed mode drive technique for the lighting system of FIG. 1.

FIG. 2 illustrates graphically the output of function generators 18 and 20 of FIG. 1 as might be employed for driving the lamp in a pulsed mode of operation to make use of the afterglow regime. As shown in FIG. 2, the pulsed input mode, represented generally by reference numeral 44, may be presented graphically as pulses having magnitudes represented along a magnitude axis 46 and occurring in time as represented along a time axis 48. Output from the first function generator 18 (see FIG. 1) used to produce the desired rate or timing between pulses exhibits short onset timing pulses 50. Spacing between the pulses 50, as represented generally at reference numeral 52, determines the onset between the ultimate pulses applied to the switching circuit 16 of FIG. 1. The output of function generator 20, then, may be represented as a series of duration pulses 54 beginning at the time of the pulses 50 output by generator 18, and ending after a desired time period. Thus, pulses 54, when applied to switching circuit 16, cause power to be applied to the lamp for the pulsed mode operation. The duration of the pulses 54, as represented generally at reference numeral 56 in FIG. 2 is dictated by function generator 20 to provide the desired energizing current to the lamp cathode and anode.

In certain implementations, as described more fully below, pulses may be applied in a bipolar fashion, such as with pulses from the function generators 18 and 20 of alternating polarity. FIG. 2 also illustrates this implementation, wherein pulses 54 have a desired duration and are of a first polarity, whereas alternate pulses 58 have an opposite polarity. The alternating polarity implementation may have certain advantages in specific lamp designs, such as lamps employing cathodes and anodes which can produce discharges based upon application of the alternating polarity drive signals.

It should also be noted that the circuitry illustrated in FIG. 1 for switching circuit 16 may be designed to apply a constant base signal to the lamp, such as in the form of a DC component. The DC component of the drive signal facilitates raising the ignition temperature to arc mode during operation of the lamp in the pulsed mode. As will be appreciated by those skilled in the art, such DC components of the drive signal may thereby enable the application of a lower amplitude voltage pulse in the pulsed mode.

Figure 3:
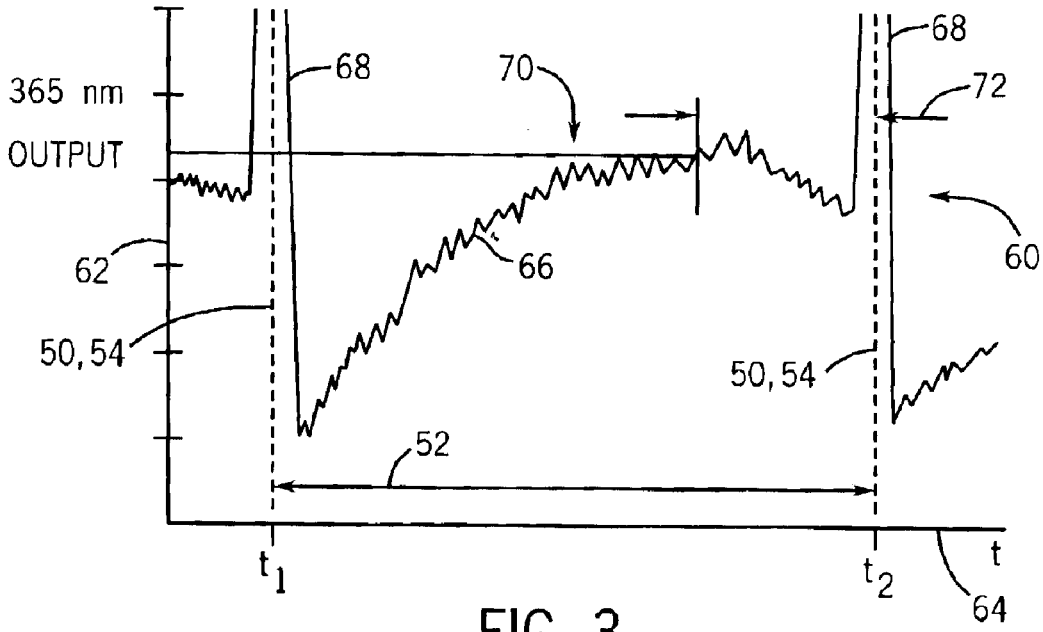
FIG. 3 is a graphical representation of desired light emission output illustrating an afterglow regime in accordance with the present technique.

The use of the ferroelectric ceramic cathode and the pulsed mode generator circuit described above permits pulses within a desired frequency range and for desired durations to be applied to the lamp to produce an afterglow from the gaseous medium as illustrated generally in FIG. 3. As used herein, the term afterglow regime or afterglow refers generally to emissions from a gaseous emissive medium which are produced after removal of a drive pulse from the medium. It has been learned that such afterglow regimes may present useful emissions in specific wavelength bands, such as a desired 365 nm band efficiently converted to a visible spectrum by conventional phosphors applied to fluorescent lamps. FIG. 3 illustrates a 365 nm afterglow trace, represented generally by the reference numeral 60 as may result from the pulsed mode operation as described above.

Referring specifically to FIG. 3, the 365 nm output is represented along an output axis 62 (in arbitrary units), and time is represented along an axis 64. An output trace 66 may be represented in which emission at a 365 nm wavelength band rises and falls as pulses are applied to the emissive medium as indicated at reference numerals 50 and 54 in FIG. 3. Substantial peaks in radiation output occur as the pulses are applied, as represented generally by reference numeral 68 in FIG. 3. Following termination of the pulses (such as during the period of application of the DC component of the drive signal), an afterglow regime causes emissions that generally rise over time, as represented at reference numeral 70. The afterglow rises in output magnitude, and may be usefully converted to output emissions from the lamp for an extended duration. As represented generally by reference numeral 72 in FIG. 3, for example, an extended delay may be employed in the timing pulses represented in FIG. 2 to make greater use of the afterglow regime and to thereby reduce the overall input power to the lamp by virtue of the delay.

Figure 4:
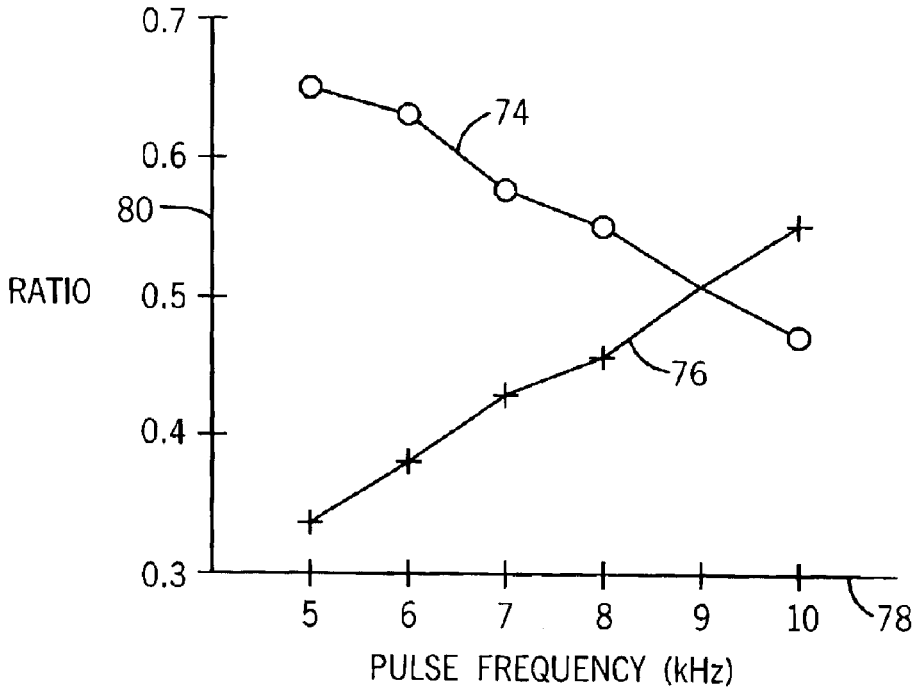
FIG. 4 is a graphical representation of ratios of pulse energy input and afterglow output to total signal energy levels integrated over time for various pulse frequencies of input drive signals.

As will be appreciated by those skilled in the art, the overall power applied to the lamp may be considered the time integral of the DC offset signal and the energy of the pulses in pulsed mode operation. It has been found that delaying pulses in the inventive pulsed mode operation both permits the integral of the input energy to be reduced over time, and permits the afterglow regime to be utilized effectively. FIG. 4 represents traces of ratios of the integral of the afterglow output to the overall energy sum at reference numeral 74, and the pulse energy input to the energy sum at reference numeral 76. The traces span a range of frequencies of pulses along a frequency axis 78, with the values for ratios determined in an exemplary implementation being indicated along an axis 80.

In a present embodiment, it has been found that pulses of a range of frequencies between, for example, approximately 5 kHz and approximately 10 kHz provide effective timing for benefiting from the afterglow regime of the gaseous medium. As the frequency of the input impulses is decreased, as illustrated at approximately 5 kHz in FIG. 4, the ratio of the afterglow output to the total output is relatively high. As pulse frequency is increased (i.e. input signals become more dominated by "on" periods of pulses than by "off" periods) the ratio of the afterglow output to the total output decreases. Conversely, as the frequency of the input signals is increased, the ratio of the energy input during the pulses to the total energy input increases substantially as illustrated by trace 76 in FIG. 4.

In accordance with the present technique, frequencies and pulse durations are applied to the lamp to make use of the afterglow regime and to optimize the output ratio as compared to the input ratio illustrated in FIG. 4. It has been found, for example, that in a mercury-rare gas low pressure discharge lamp of a standard T8 size, with a 3.5 A current pulse and a 600 Vdc power supply, the integrated value of the 365 nm spectral band from excited atomic mercury during the afterglow was more than 60% of the total overall contribution of the emission in the 365 nm band. The resulting shift in the spectral line, then, implies that conversion of the output emission to the visible spectrum is more energetically efficient due to the characteristics of the phosphor used in the lamp. The duration of the pulses was on the order of less than 1 $\mu$s, and the voltage of the pulses applied was greater than 1 kV. In a preferred implementation, the pulse width was substantially smaller than 1 $\mu$s and the pulse magnitude was on the order of 1.4 kV. Ferroelectric ceramic discs used for cathodes, operating by electron emission during high voltage-induced phase transitions, were used to enhance the life of the cathodes. Such cathodes are generally available and may provide electron current densities, for example, as high as 400 A/cm$^2$.

Figure 5:
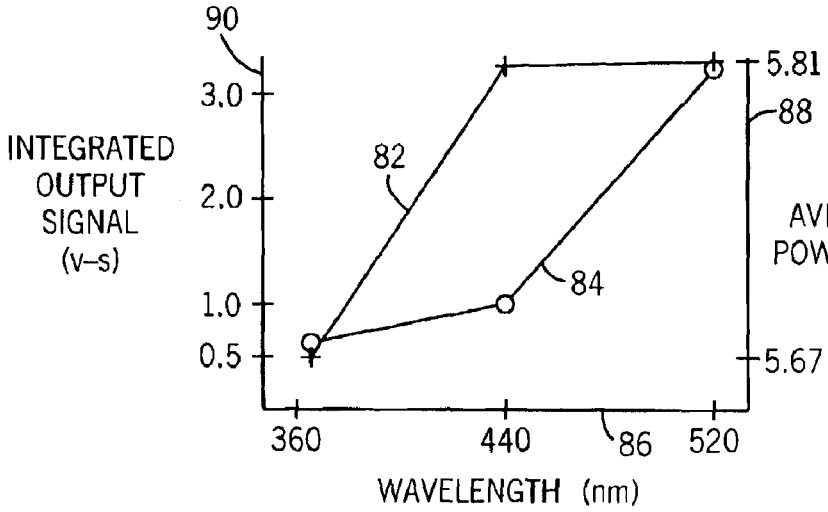
FIG. 5 PRIOR ART
FIG. 5 is a graphical representation of integrated output emissions at various wavelengths and average power for driving a conventional system.

While the present technique provides for enhanced emissions from the desired wavelength band, such as the 365 nm band as discussed above, conventional systems, typically operating in high frequency modes of operation, tend to require higher average power input and produce output signals shifted to other wavelength bands, typically those of higher energy levels that are less efficiently converted to the visible spectrum. As illustrated in FIG. 5, for example, an input trace 82 of a conventional system may be drawn for input power at various wavelength bands, with an output trace 84 being drawn for output at the wavelength bands. In the illustration of FIG. 5, wavelengths are shown along a horizontal axis 86, average input power along an axis 88, and integrated output signals along a vertical axis 90. As FIG. 5 illustrates, power varied little at the different wavelengths, with an input power of approximately 5.7 watts average. The output, however, varied substantially, with output at a 365 nm wavelength band being substantially lower than output at higher wavelength bands, including output at a 254 nm (second order) band illustrated in the upper right of trace 84. By comparison with the ratios of FIG. 4, then, the present technique provides for enhanced output the desired wavelength band (e.g. 265 nm) with reduced integrated input power represented by the pulses as compared to total input power (see trace 76 of FIG. 4).

Figure 6:
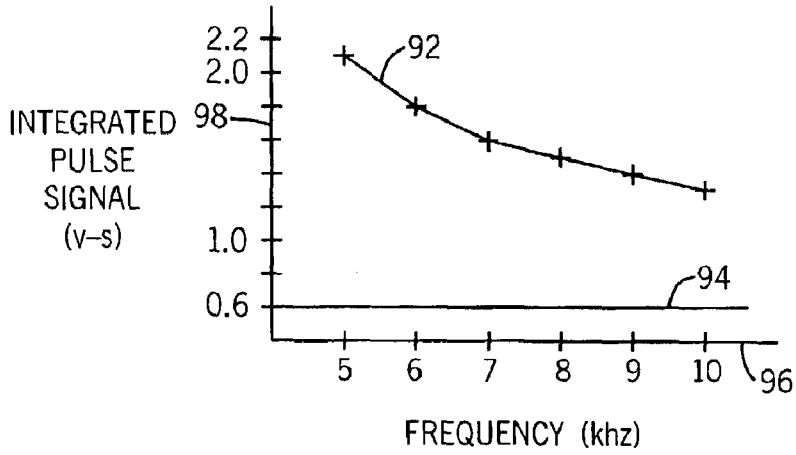
FIG. 6 is a graphical representation of integrated pulse signals for the present technique and for conventional drive systems over a range of frequencies.

At the same time, the present technique provides for elevated levels of output at the desired wavelengths, such as 365 nm, as compared to standard high frequency drive modes. FIG. 6 represents a total output trace 92 over a range of drive frequencies, and an output trace 94 expected to result from conventional high frequency lamp drive circuits (e.g. typically 20–25 kHz sinusoidal waveform pulses, at voltages of approximately 100V). In FIG. 6, the output is illustrated for a range of frequencies for the pulsed mode operation, as with FIG. 4 above, as indicated along axis 96, while integrated output signals are illustrated along vertical axis 98. As can be seen from FIG. 6, output in the 365 nm wavelength band was substantially elevated as compared to conventional high frequency drive output. Accordingly, with less overall power input for the present pulsed mode operation, enhanced output at the desired wavelength band was obtained that can be more efficiently converted to the visible spectrum.

Figure 7:
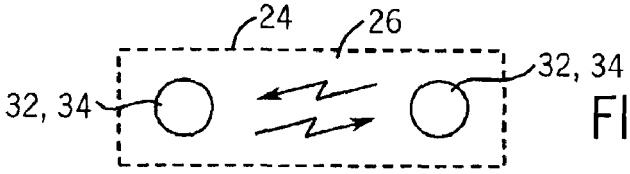
FIGS. 7 and 8 represent alternative configurations for anode and cathode arrangements used in the pulsed mode drive techniques disclosed herein.
Figure 8:
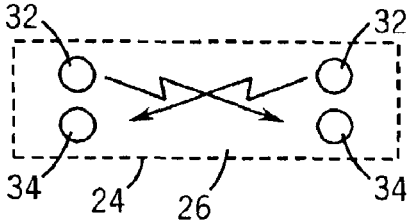

As noted above, the use of ferroelectric ceramic disc cathodes is preferred in present implementations due to the pulsed mode operation and the enhanced life afforded by such cathode materials. FIGS. 7 and 8 illustrate exemplary alternative configurations for anodes and cathodes. FIG. 7 generally represents a combination anode/cathode as represented by reference numerals 32 and 34, in which alternating polarity pulses may be applied to the structures to provoke the desired discharge and emission. In the embodiment of FIG. 8, an anode and a cathode are provided on either end of the lamp shell 24, and drive circuitry would apply signals alternatingly to the anode and cathode to provoke the discharges and resulting emissions in the pulsed mode operation.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A fluorescent lighting system comprising:

a hollow vessel;

a fluorescent layer disposed on an interior surface of the vessel;

a gaseous medium disposed within the vessel;

electrodes in contact with the gaseous medium, at least one of the electrodes comprising a ceramic structure; and a drive circuit coupled to the electrodes and adapted to apply pulsed drive signals to at least one of the electrodes from a non-zero voltage to a desired maximum voltage to produce light emission from the gaseous medium within a desired wavelength.

2. The system of claim 1, wherein the drive signals are applied at a frequency of less than approximately 10 kHz.

3. The system of claim 2, wherein the drive signals are applied at a frequency of less than approximately 5 kHz.

4. The system of claim 1, wherein the drive signals include elevated voltage pulses of a duration of less than approximately 1 microsecond.

5. The system of claim 1, wherein the desired maximum voltage is greater than approximately 1 kilovolt.

6. The system of claim 5, wherein the desired maximum voltage is greater than approximately 1.4 kilovolts.

7. The system of claim 1, wherein the desired wavelength includes a band of approximately 365 nanometers.

8. The system of claim 1, wherein the gaseous medium includes mercury and a buffer gas.

9. The system of claim 8, wherein the buffer gas is helium or argon.

10. The system of claim 1, wherein the gaseous medium is under a pressure of from 1 to 5 Torr.

11. The system of claim 10, wherein the gaseous medium is under a pressure of from 1 to 2 Torr.

12. A fluorescent lighting system comprising:

a hollow vessel;

a fluorescent layer disposed on an interior surface of the vessel;

a gaseous medium disposed within the vessel;

an anode in contact with the gaseous medium;

an emissive ferroelectric ceramic cathode in contact with the gaseous medium; and a drive circuit coupled to the anode and the cathode and adapted to apply pulsed drive signals to the cathode from a non-zero voltage to a desired maximum voltage to produce light emission from the gaseous medium within a desired wavelength, the drive signals including pulses producing an afterglow regime including an elevated level of the desired wavelength emission from the gaseous medium, the pulses being of a duration and frequency based upon a duration of the afterglow regime.

13. The system of claim 12, wherein the drive signals are applied at a frequency of less than approximately 10 kHz.

14. The system of claim 13, wherein the drive signals are applied at a frequency of less than approximately 5 kHz.

15. The system of claim 12, wherein the drive signals include elevated voltage pulses of a duration of less than approximately 1 microsecond.

16. The system of claim 12, wherein the desired maximum voltage is greater than approximately 1 kilovolt.

17. The system of claim 16, wherein the desired maximum voltage is greater than approximately 1.4 kilovolts.

18. The system of claim 12, wherein the desired wavelength includes a band of approximately 365 nanometers.

19. The system of claim 12, wherein the gaseous medium includes mercury and a buffer gas.

20. The system of claim 19, wherein the buffer gas is helium or argon.

21. The system of claim 12, wherein the gaseous medium is under a pressure of from 1 to 5 Torr.

22. The system of claim 21, wherein the gaseous medium is under a pressure of from 1 to 2 Torr.

23. A lighting system comprising:

a fluorescent lamp having a gaseous emissive medium and ferroelectric ceramic cathode in contact with the medium; and a drive circuit configured to apply drive signals to the cathode in pulsed mode to increase emissions within a 365 nm wavelength band, wherein the drive signals include voltage pulses from a non-zero voltage to a desired maximum voltage to produce light emission from the gaseous medium within the 365 nm wavelength band during a afterglow regime, the pulses being of a duration and frequency based upon a duration of the afterglow regime.

24. The system of claim 23, wherein the drive signals are applied at a frequency of less than approximately 10 kHz.

25. The system of claim 24, wherein the drive signals are applied at a frequency of less than approximately 5 kHz.

26. The system of claim 23, wherein the drive signals include elevated voltage pulses of a duration of less than approximately 1 microsecond.

27. The system of claim 23, wherein the desired maximum voltage is greater than approximately 1 kilovolt.

28. The system of claim 27, wherein the desired maximum voltage is greater than approximately 1.4 kilovolts.

29. The system of claim 23, wherein the gaseous medium includes mercury and a buffer gas.

30. The system of claim 29, wherein the buffer gas is helium or argon.

31. The system of claim 23, wherein the gaseous medium is under a pressure of from 1 to 5 Torr.

32. The system of claim 31, wherein the gaseous medium is under a pressure of from 1 to 2 Torr.

33. A method for operating a fluorescent lighting system, the method comprising:

applying pulsed drive signals to a lamp having a ferroelectric ceramic cathode in contact with a gaseous emissive medium, the drive signals comprising voltage pulses rising from a non-zero voltage to a desired maximum voltage to produce light emission from the gaseous medium within a desired wavelength, the drive signals including pulses producing an afterglow regime including an elevated level of the desired wavelength emission from the gaseous medium, the pulses being of a duration and frequency based upon a duration of the afterglow regime.

34. The method of claim 33, wherein the drive signals are applied at a frequency of less than approximately 10 kHz.

35. The method of claim 34, wherein the drive signals are applied at a frequency of less than approximately 5 kHz.

36. The method of claim 33, wherein the drive signals include elevated voltage pulses of a duration of less than approximately 1 microsecond.

37. The method of claim 33, wherein the desired maximum voltage is greater than approximately 1 kilovolt.

38. The method of claim 37, wherein the desired maximum voltage is greater than approximately 1.4 kilovolts.

39. The method of claim 33, wherein the desired wavelength includes a band of approximately 365 nanometers.

40. The method of claim 33, wherein the gaseous medium includes mercury and a buffer gas.

41. The method of claim 40, wherein the buffer gas is helium or argon.

42. The method of claim 33, wherein the gaseous medium is under a pressure of from 1 to 5 Torr.

43. The method of claim 42, wherein the gaseous medium is under a pressure of from 1 to 2 Torr.

44. A fluorescent lighting system comprising:

a hollow vessel;

a fluorescent layer disposed on an interior surface of the vessel;

a gaseous medium disposed within the vessel;

electrodes in contact with the gaseous medium, at least one of the electrodes comprising a ceramic structure;

a drive circuit coupled to the electrodes and adapted to apply pulsed drive signals to at least one of the electrodes from a non-zero voltage to a desired maximum voltage to produce light emission from the gaseous medium within a desired wavelength; and wherein the drive signals are applied at a frequency of less than approximately 10 kHz.

45. A fluorescent lighting system comprising:

a hollow vessel;

a fluorescent layer disposed on an interior surface of the vessel;

a gaseous medium disposed within the vessel;

an anode in contact with the gaseous medium;

an emissive cathode in contact with the gaseous medium; and a drive circuit coupled to the anode and the cathode and adapted to apply pulsed drive signals to the cathode from a non-zero voltage to a desired maximum voltage to produce light emission from the gaseous medium within a desired wavelength, the drive signals including pulses producing an afterglow regime including an elevated level of the desired wavelength emission from the gaseous medium, the pulses being of a duration and frequency based upon a duration of the afterglow regime; and wherein at least one of the anode and cathode comprises a ceramic structure, and the desired maximum voltage is greater than approximately 1 kilovolt.

46. A lighting system comprising:

a fluorescent lamp having a gaseous emissive medium, an anode and a cathode in contact with the medium, at least one of the anode and cathode comprising a ceramic structure; and a drive circuit configured to apply drive signals to the cathode in pulsed mode to increase emissions within a 365 nm wavelength band; and wherein the drive signals are applied at a frequency of less than approximately 10 kHz.

47. A method for operating a fluorescent lighting system, the method comprising:

applying pulsed drive signals to a lamp having a ceramic cathode in contact with a gaseous emissive medium, the drive signals comprising voltage pulses rising from a non-zero voltage to a desired maximum voltage to produce light emission from the gaseous medium within a desired wavelength, the drive signals including pulses producing an afterglow regime including an elevated level of the desired wavelength emission from the gaseous medium, the pulses being of a duration and frequency based upon a duration of the afterglow regime wherein the drive signals are applied at a frequency of less than approximately 10 kHz.

* * * * *